US007497194B2

(12) United States Patent
Tachino et al.

(10) Patent No.: US 7,497,194 B2
(45) Date of Patent: Mar. 3, 2009

(54) TAPPET CLEARANCE AUTOMATIC ADJUSTING DEVICE AND ADJUSTING METHOD

(75) Inventors: Yasuyuki Tachino, Sayama (JP); Toshiyuki Miyajima, Sayama (JP); Tomoaki Tsuyoshi, Sayama (JP)

(73) Assignee: Honda Motor Co., Ltd., Tokyo (JP)

( * ) Notice: Subject to any disclaimer, the term of this patent is extended or adjusted under 35 U.S.C. 154(b) by 153 days.

(21) Appl. No.: 11/666,807

(22) PCT Filed: Sep. 30, 2005

(86) PCT No.: PCT/JP2005/018195

§ 371 (c)(1),
(2), (4) Date: May 1, 2007

(87) PCT Pub. No.: WO2006/048986

PCT Pub. Date: May 11, 2006

(65) Prior Publication Data

US 2008/0127924 A1 Jun. 5, 2008

(30) Foreign Application Priority Data

Nov. 5, 2004 (JP) ..... 2004-321995

(51) Int. Cl.
*F01L 1/14* (2006.01)

(52) U.S. Cl. ..... 123/90.52; 123/90.39; 123/90.48; 123/90.54; 74/559

(58) Field of Classification Search ..... 123/90.39, 123/90.44, 90.46, 90.48, 90.52, 90.54, 90.55; 74/559, 567, 569
See application file for complete search history.

(56) References Cited

U.S. PATENT DOCUMENTS 7,305,952 B2 * 12/2007 Katou et al. ..... 123/90.48

FOREIGN PATENT DOCUMENTS

| | | |
|---|---|---|
| JP | 56-077505 | 6/1981 |
| JP | 03-206306 | 9/1991 |
| JP | 09-177520 | 7/1997 |
| JP | 09-303120 | 11/1997 |
| JP | 11-153007 | 6/1999 |
| JP | 2001-027106 | 1/2001 |
| JP | 2004-245111 | 9/2004 |

* cited by examiner

*Primary Examiner*—Ching Chang
(74) *Attorney, Agent, or Firm*—Carrier, Blackman & Associates, P.C.; Joseph P. Carrier; William D. Blackman

(57) ABSTRACT

A tappet clearance automatic adjusting device comprising an adjusting unit for advancing/retracting an adjust screw from the forward end of a rocker arm and adjusting the projection amount, a torque detecting section for detecting the torque by rotating the adjust screw, and a control mechanism section for controlling the adjusting unit based on a torque value measured at the torque detecting section. The control mechanism section starts retracting the adjust screw when a valve is opened and continuously measures the torque value obtained when the valve is closed. A position, corresponding to time when variation in the filtering value obtained by smoothing the torque value through moving average is a threshold value or smaller, is detected as a reference point and the adjust screw is retracted from the reference point by a set amount.

8 Claims, 14 Drawing Sheets

TAPPET CLEARANCE AUTOMATIC ADJUSTING DEVICE AND ADJUSTING METHOD

CROSS-REFERENCE TO RELATED APPLICATIONS

The present application is a U.S. National phase of, and claims priority based on PCT/JP2005/018195, filed 30 Sep. 2005, which, in turn, claims priority from Japanese patent application 2004-321995, filed 5 Nov. 2004. The entire disclosure of each of the referenced priority documents is incorporated herein by reference.

TECHNICAL FIELD

The present invention relates to an automatic tappet clearance adjusting apparatus and an adjusting method for adjusting a clearance between a valve and an adjustment screw in an engine, in which the valve that is closed by a spring is opened by being pressed by an adjustment screw on a distal end of a rocker arm.

BACKGROUND ART

Engines of the type in which a rocker arm is provided in a valve mechanism draw in and discharge a fuel gas and an exhaust gas by pressing a valve end, so as to open the valve with an adjustment screw on the distal end of a rocker arm that is actuated by a cam. When the rocker arm returns to an original position, the valve is closed again under a resilient force of a spring.

A clearance (hereinafter referred to as a tappet clearance) is provided between the valve end and the adjustment screw, for allowing the valve to be fully closed when the rocker arm returns to the original position. If the tappet clearance is too small, then the clearance may possibly be eliminated due to thermal expansion at high temperatures. If the tappet clearance is too large, then the valve end and the adjustment screw produce large sounds as noise when they contact each other. Therefore, the tappet clearance has to be adjusted accurately to an appropriate value (or within an appropriate range) that is preset in design. Particularly, a process for manufacturing a large quantity of engines in a wide variety of types needs to have a reduced adjustment time per engine, while maintaining a high adjustment accuracy level. It is preferable to be able to adjust tappet clearances automatically in order to prevent adjustment fluctuations.

Processes for adjusting tappet clearances are disclosed in Japanese Patent Publication No. 62-8609, Japanese Laid-Open Patent Publication No. 11-153007, and Japanese Laid-Open Patent Publication No. 2001-27106. An adjustment apparatus used by the process disclosed in Japanese Patent Publication No. 62-8609 has an actuator for rotating a driver, a displacement measuring device for measuring displacement of a valve in directions in which the valve is opened and closed, and a means for engaging a rocker arm to press a pad surface of the rocker arm against a cam surface. The means for engaging the rocker arm has a pressing lever element for pressing the pad surface against the cam surface under strong forces. The pressing lever element presses the pad surface reliably against the cam surface for increased adjustment accuracy.

According to the process described in Japanese Laid-Open Patent Publication No. 11-153007, the tappet clearance is adjusted while the pressure in the combustion chamber that is supplied with air under high pressure is being monitored. The tappet clearance can be adjusted accurately almost without requiring any skill. According to the process described in Japanese Laid-Open Patent Publication No. 2001-27106, a point of origin for adjustment is determined from a point where the displacement of the rocker arm is reduced by a reference quantity.

The pressing lever element used by the process described in Japanese Patent Publication No. 62-8609 is complex in structure, as it needs an air microcylinder for actuation and a rotational pivot shaft as a lever mechanism. Since the pressing lever element is separate from the displacement measuring device, the apparatus is large in size.

According to the process described in Japanese Laid-Open Patent Publication No. 11-153007, because the pressure in the combustion chamber is relatively high, air flow tends to be disturbed, and hence accurate measurements cannot be made until the pressure in the combustion chamber is stabilized. Accordingly, it may be difficult to adjust the tappet clearance quickly. Furthermore, since a worker uses a screwdriver to adjust the distance at which an adjustment screw is threaded in, it is desirable to make the process automatic in order to reduce the burden on the worker, as well as to adjust the tappet clearance with higher accuracy in a shorter period of time.

According to the process described in Japanese Laid-Open Patent Publication No. 2001-27106, a worker determines the point of origin for adjustment based on displacement of the rocker arm. Consequently, the process requires a sensor for detecting displacement, and requires that a sensor signal be linked to the adjustment apparatus. A setting process is performed in order to convert the reference quantity for the determined displacement into a rotational angle and an advanced distance, based on the relationship between the pitch and lead of the adjustment screw, so as to determine a final completion point.

When adjustments are made with respect to a large quantity of engines in a wide variety of types, because valves and adjustment screws having different shapes and characteristics are required for a variety of engines, it is difficult to make a uniform adjustment.

DISCLOSURE OF THE INVENTION

It is an object of the present invention to provide an automatic tappet clearance adjusting apparatus and an adjusting method for adjusting the clearance between a valve and an adjustment screw, so that such adjustments can be made more quickly and accurately with simple structures and means, with respect to a large quantity of engines in a wide variety of types.

It is also an object of the present invention to identify a reference point for a tappet clearance highly accurately, regardless of play in a tool that engages an adjustment screw, or backlash of the drive system, etc.

According to the present invention, an automatic tappet clearance adjusting apparatus for adjusting a clearance between a valve and an adjustment screw in an engine, in which the valve that is closed by a spring is opened by being pressed by an adjustment screw on a distal end of a rocker arm, comprises an adjustment unit for advancing and retracting the adjustment screw from the distal end of the rocker arm to adjust a projection of the adjustment screw, a torque detector for detecting a torque to rotate the adjustment screw, and a control mechanism for controlling the adjustment unit based on a bidirectional torque value successively measured by the torque detector, wherein the control mechanism determines a filtering value produced by smoothing the torque value applied to retract the adjustment screw to close the valve from a state in which the valve is open, identifies as the reference point, either a location at which a valve head of the valve first contacts a valve seat of the engine, in order to start reducing the filtering value, or a location at which after the valve head of the valve contacts the valve seat of the engine, the adjustment screw is spaced from an end of the valve to thereby hold the filtering value at a constant value, and then retracts the adjustment screw from the current position to a position retracted by a set quantity based on the clearance from the reference point.

Since the torque value applied to retract the adjustment screw to close the valve is measured at each of a plurality of very small time intervals, and a reference point is detected at which the gradient of the filtering value produced by smoothing the torque value is equal to or smaller than the threshold, even if a noise component is added to a curve represented by the torque value, or if an obtained curve shape is different from a standard curve, the reference point can be identified accurately. It is thus possible to adjust the clearance between the valve and the adjustment screw quickly and with high accuracy, by retracting the adjustment screw by the set quantity based on the clearance from the reference point.

If the filtering value is determined by a moving average process, then the calculation procedure is simple, enabling a high-speed process to be performed.

The control mechanism detects, as the reference point, a location at which a valve head of the valve first contacts a valve seat of the engine, in order to start reducing the torque value. Alternatively, the control mechanism may detect, as the reference point, a location at which after a valve head of the valve contacts a valve seat of the engine, the adjustment screw is spaced from an end of the valve to thereby hold the torque value at a constant value.

As described above, the location at which the torque value for retracting the valve starts to be reduced, or the location at which the torque value is a constant value, is identified as the reference point. The reference point can be identified highly accurately regardless of play in a tool of the adjustment unit that engages with the adjustment screw, backlash of the drive system, etc.

If the adjustment unit is moved by a programmable multi-axis robot to change an angle of approach while the robot is maintained in synchronism with displacement of the rocker arm, then the adjustment unit is flexible enough to handle engines in which the rocker arms and adjustment screws thereof have different positions and directions.

If the automatic tappet clearance adjusting apparatus is installed in a station on a production line, then the automatic tappet clearance adjusting apparatus can suitably be used to adjust mass-produced engines.

According to the present invention, an automatic tappet clearance adjusting method, for adjusting a clearance between a valve and an adjustment screw in an engine in which the valve that is closed by a spring is opened by being pressed by an adjustment screw on a distal end of a rocker arm, comprises the step of employing an adjustment unit for advancing and retracting the adjustment screw from the distal end of the rocker arm in order to adjust the projection of the adjustment screw, a torque detector for detecting a torque to rotate the adjustment screw, and a control mechanism for controlling the adjustment unit based on a bidirectional torque value successively measured by the torque detector, wherein the control mechanism determines a filtering value produced by smoothing the torque value applied to retract the adjustment screw to close the valve from a state in which the valve is open, identifies, as the reference point, either a location at which a valve head of the first valve contacts a valve seat of the engine, in order to start reducing the filtering value, or a location at which after the valve head of the valve contacts the valve seat of the engine, the adjustment screw is spaced from an end of the valve to thereby hold the filtering value at a constant value, and then retracts the adjustment screw from a current position to a position retracted by a set quantity based on the clearance from the reference point.

BEST MODE FOR CARRYING OUT THE INVENTION

An automatic tappet clearance adjusting apparatus, and an adjusting method according to an embodiment of the present invention, shall be described below with reference to FIGS. 1 through 14 of the accompanying drawings.

Figure 1:
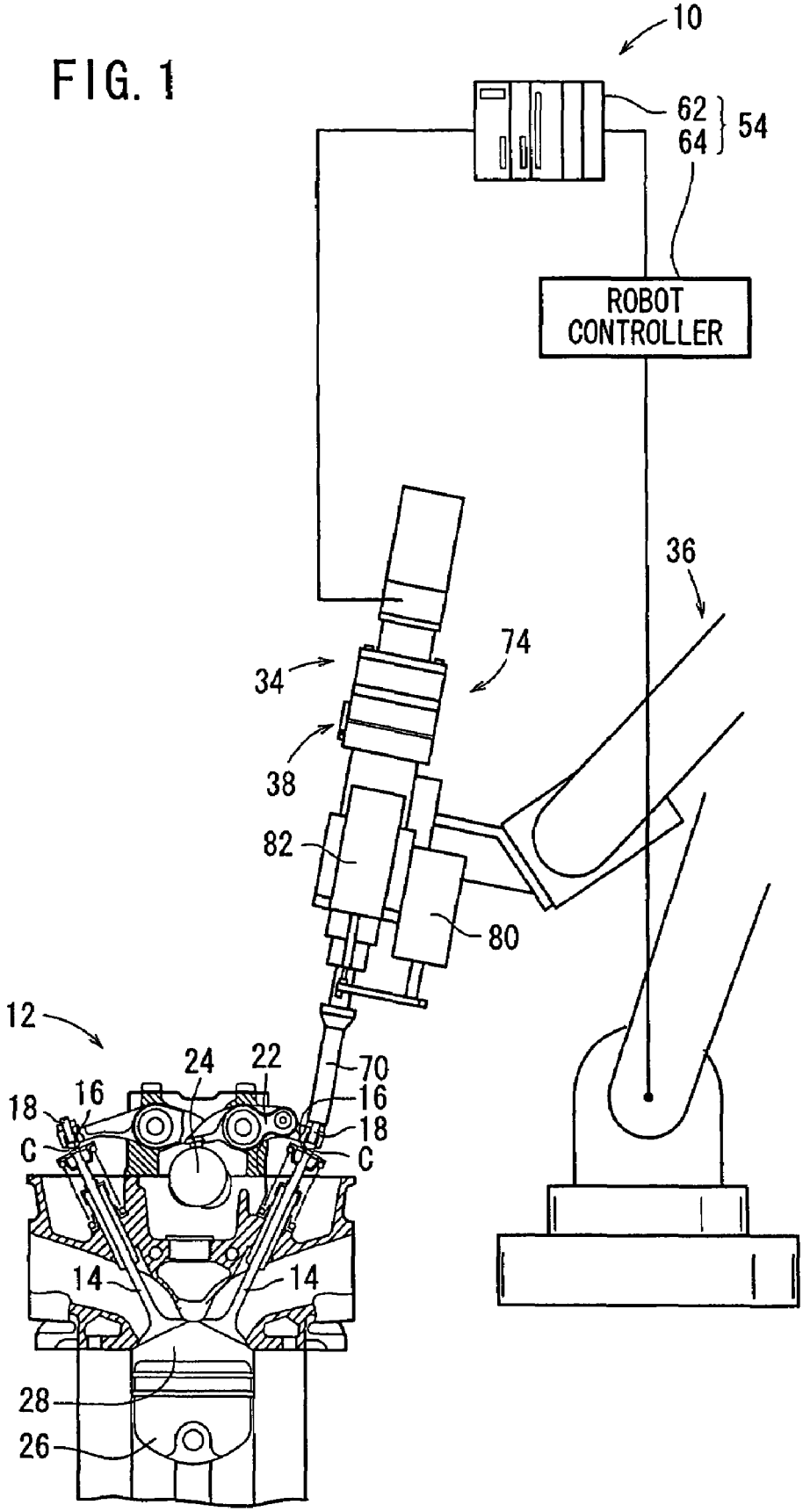
FIG. 1 is a block diagram of an automatic tappet clearance adjusting apparatus according to an embodiment of the present invention.

As shown in FIG. 1, an automatic tappet clearance adjusting apparatus 10 according to an embodiment of the present invention operates to adjust a clearance (hereinafter referred to as a tappet clearance) C between a valve end 16 of a valve 14 of an engine 12 and an adjustment screw 18. The adjustment screw 18 is a fine right-handed screw, which is advanced downwardly when rotated clockwise.

Figure 2:
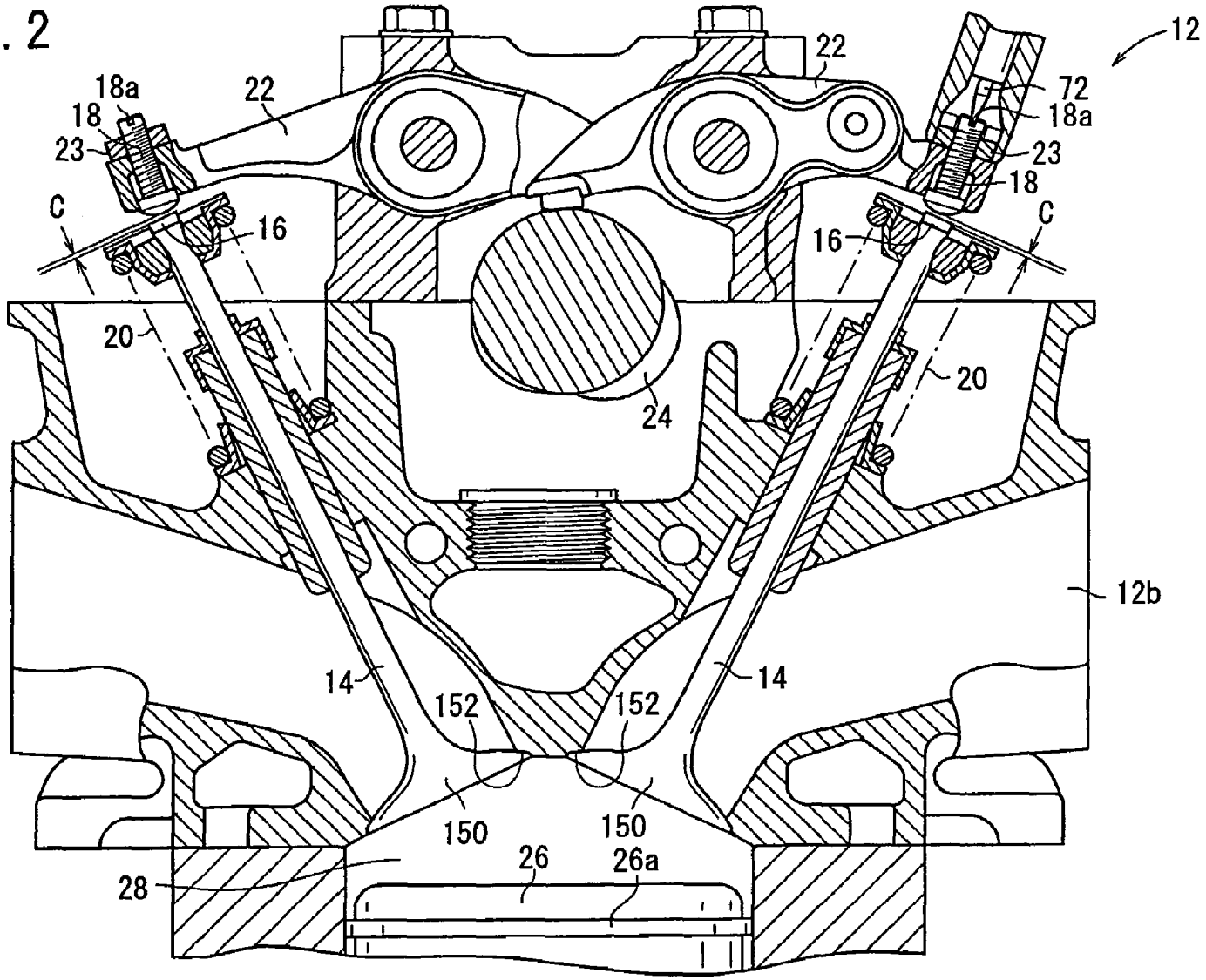
FIG. 2 is a cross-sectional view of an engine.

As shown in FIG. 2, the adjustment screw 18 has a screw section having a straight slot 18*a* defined in an upper end thereof, the screw section being threaded into the distal end of a rocker arm 22. The adjustment screw 18 is fixed in place by an adjustment nut 23, by means of a double-nut configuration. The engine 12 is of a type wherein the valve end 16 of the valve 14, which is closed by a spring 20, is pressed by the adjustment screw 18 on the distal end of the rocker arm 22 in order to open the valve 14. Specifically, the rocker arm 22 is actuated by a cam 24 so as to cause the adjustment screw 18 to press the valve end 16, for thereby opening the valve 14 to draw in a fuel gas or to discharge an exhaust gas. When the rocker arm 22 returns to its original position, the valve 14 is closed again under the resiliency of the spring 20.

For adjusting the clearance C, the cam 24 is set so that the cam lobe thereof is directed downwardly and the rocker arm 22 returns to its original position. Therefore, in both intake and exhaust strokes, the valves 14 are placed in positions for closing an intake pipe and an exhaust pipe, respectively, and a piston 26, which is ganged with the cam 24, is lifted to a top dead center position, providing a combustion chamber 28 as a small space.

With the adjustment nut 23 being loosened, the adjustment screw 18 advances or retracts in order to change the tappet clearance C when it is turned by a screwdriver (tool) 72 inserted into the straight slot 18*a* defined in the rear end of the adjustment screw 18. When the tappet clearance C is adjusted to a suitable value, the adjustment nut 23 is tightened in order to secure the adjustment screw 18.

Referring back to FIG. 1, the automatic tappet clearance adjusting apparatus 10 has an adjustment unit 34 for advancing and retracting the adjustment screw 18 after having loosened the adjustment nut 23, a robot (moving mechanism) 36 programmed for moving the adjustment unit 34 to a desired position in a desired direction, a torque detector 38 for detecting a torque for rotating the adjustment screw 18, and a control mechanism 54 for controlling the adjustment unit 34 based on a torque value T measured by the torque detector 38.

The control mechanism 54 includes a PLC (Programmable Logic Controller) 62 and a robot controller 64. The PLC 62 stores successive torque values T in a given data register, calculates reliable differential values, controls the adjustment unit 34 based on the calculated results, etc., and transmits a predetermined timing signal to the robot controller 64. Based on the received timing signal, the robot controller 64 controls the robot 36 to move and bring the distal end of the adjustment unit 34 into abutment against the adjustment screw 18. The robot 36 comprises a multiaxis industrial robot.

Figure 3:
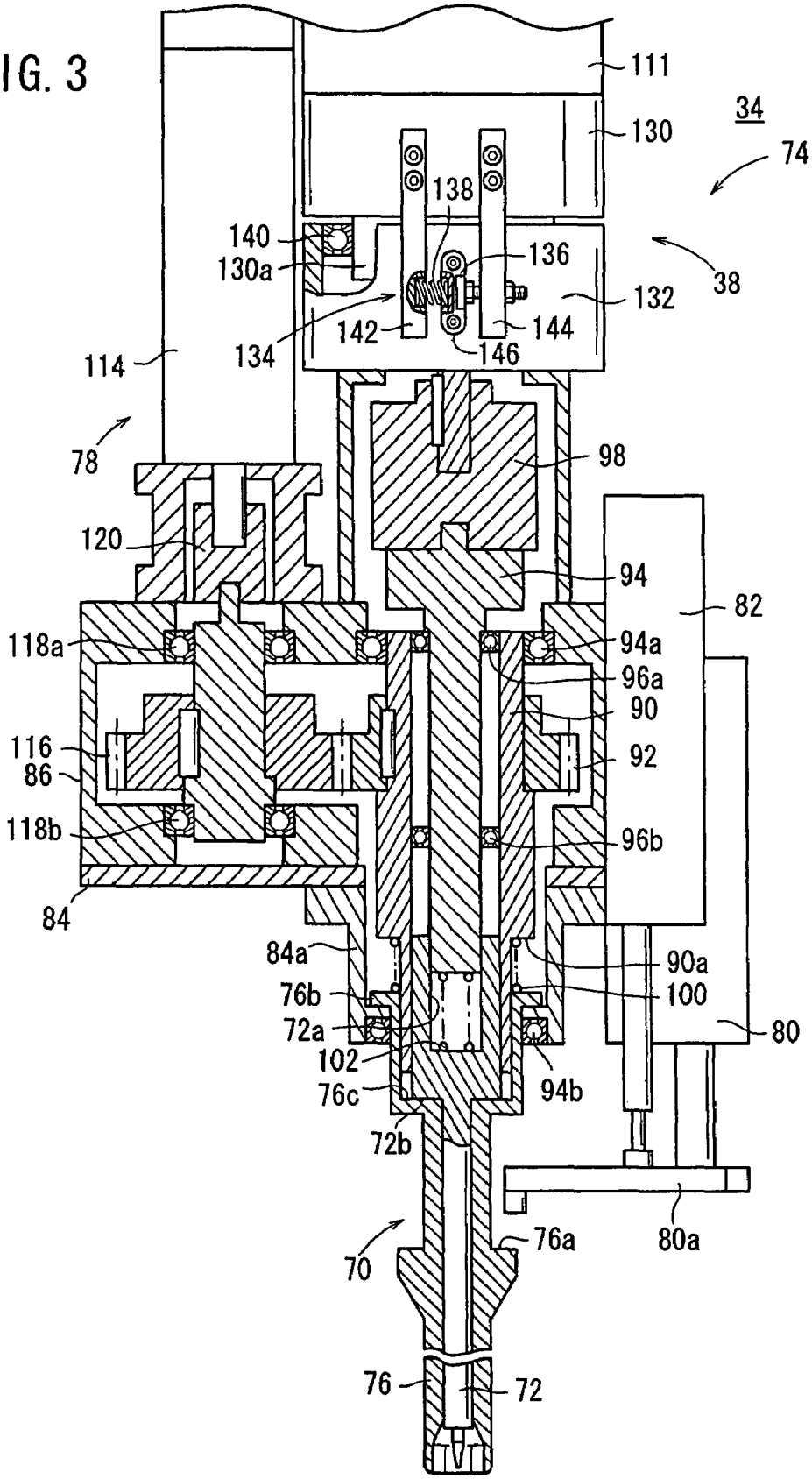
FIG. 3 is a sectional front elevational view of an adjustment unit.
Figure 4:
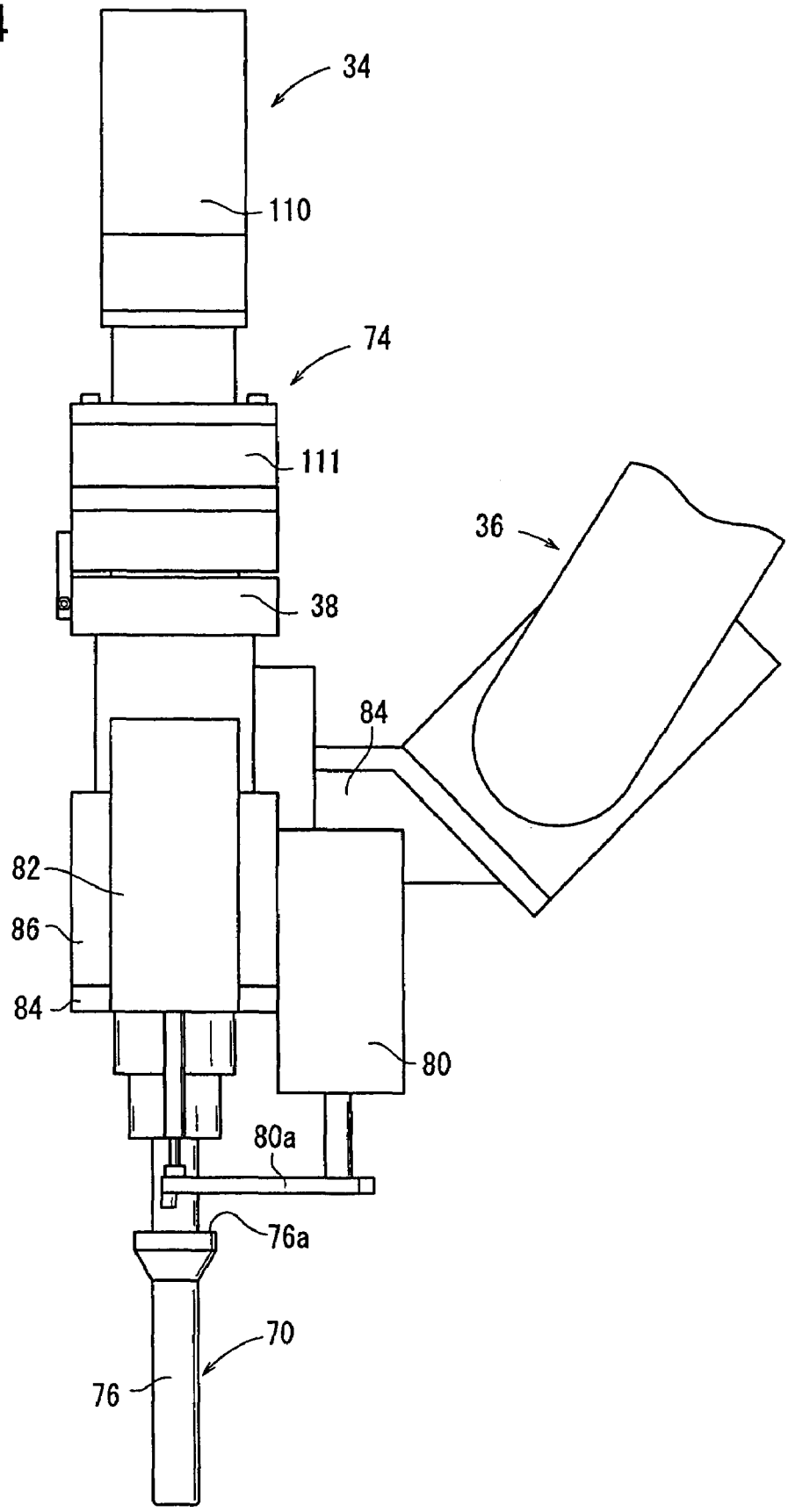
FIG. 4 is a side elevational view of the adjustment unit.

As shown in FIGS. 3 and 4, the adjustment unit 34 is mounted on the distal end of the robot 36. The adjustment unit 34 comprises a cylindrical working unit 70 for operating the adjustment screw 18 and the adjustment nut 23, a screwdriver 72 mounted in the distal end of a core shaft of the working unit 70, a screwdriver rotator 74 for actuating the screwdriver 72, a socket 76 disposed coaxially around the screwdriver 72, a nut runner 78 for actuating the socket 76, a pneumatic cylinder 80 for bringing a plate 80*a* into abutment against a detecting seat 76*a* in order to measure a distance by which the socket 76 is advanced or retracted, and a magnescale 82 coupled to the plate 80*a* for measuring the position of the detecting seat 76*a* in order to detect displacement of the rocker arm 22 in real time. The pneumatic cylinder 80 and the magnescale 82 are mounted on a joint bracket 84 connected to the robot 36. For making such measurements, the pneumatic cylinder 80 may be small in size and weight and does not need to produce a large output.

The screwdriver rotator 74 is mounted coaxially with the working unit 70 on an upper surface of the joint bracket 84 by a casing 86. The nut runner 78 is disposed adjacent and parallel to the screwdriver rotator 74, and extends upwardly from an upper surface of the casing 86.

The working unit 70 projects downwardly from the joint bracket 84, while the screwdriver 72 and the socket 76 are disposed on the distal end of the working unit 70. The working unit 70 has a rotary tube 90 with a distal end having splines fitted into an upper hole in the socket 76, a driven gear 92 coaxially fixed onto the rotary tube 90 in the casing 86, and a coupling rod 94 extending through an axial hole in the rotary tube 90 and with a distal end having splines fitted into an upper hole 72*a* in the screwdriver 72.

The rotary tube 90 is rotatably supported in the casing 86 by bearings 94*a*, 94*b* in a support tube 84*a* projecting downwardly from the joint bracket 84. When the driven gear 92 is rotated, the rotary tube 90 is rotated in unison therewith, and such rotation is transmitted by the splines to rotate the socket 76. The coupling rod 94 is rotatably supported by two bearings 96*a*, 96*b* disposed on an inner surface of the rotary tube 90. When a coupling 98 mounted on the upper end of the coupling rod 94 is rotated, the coupling rod 94 is rotated in unison therewith, and rotation is transmitted by the splines to rotate the screwdriver 72.

A spring 100 is disposed between a side step 90*a* of the rotary tube 90 and an upper end face of the socket 76, so as to resiliently bias the rotary tube 90 downwardly. The socket 76 has an outer ring 76*b* on an upper portion thereof, which engages in an inner annular groove in the support tube 84*a* in order to prevent the socket 76 from becoming dislodged.

A spring 102 is disposed between the lower end face of the coupling rod 94 and the bottom of the upper hole 72*a* in the screwdriver 72 so as to resiliently bias the screwdriver 72 downwardly. The screwdriver 72 has an outer step 72*b*, which engages an inner step 76*c* of the socket 76 in order to prevent the screwdriver 72 from becoming dislodged.

The screwdriver 72 has a straight lower distal end for engaging in the straight slot 18*a*. The socket 76 has a lower distal end having an inner circumferential surface with a hexagonal socket shape for engagement with the adjustment nut 23.

The screwdriver rotator 74 comprises a servomotor 110, the angular displacement R of which can be detected, a speed reducer 111 for transmitting rotation of the servomotor 110 at a reduced speed to the coupling 98, and a torque detector 38. The servomotor 110, the speed reducer 111, and the torque detector 38 are successively arranged in series from above.

The nut runner 78 includes a motor 114, a drive gear 116 for transmitting rotation of the motor 114 at a reduced speed to the driven gear 92, and bearings 118*a*, 118*b* supporting the shaft of the drive gear 116. A coupling 120 is disposed between the rotational shaft of the motor 114 and the drive gear 116. The motor 114, the drive gear 116, the coupling 120, the driven gear 92, and the bearings 118*a*, 118*b* are housed within the casing 86.

The magnescale 82 is capable of detecting displacement of the rocker arm 22 in real time. Therefore, based on the measured displacement of the rocker arm 22, the robot 36 can set the position and direction of the adjustment unit 34 so as to reliably hold the socket and the adjustment nut 23 in engagement with each other, and also to reliably hold the screwdriver 72 and the adjustment screw 18 in engagement with each other.

The torque detector 38 comprises a stepped cylindrical drive unit 130, a hollow cylindrical driven unit 132 disposed coaxially with and downwardly from the drive unit 130, a drive force transmitting engagement unit 134 for transmitting rotation of the drive unit 130 to the driven unit 132, a load cell 136 mounted in the drive force transmitting engagement unit 134 for detecting force oriented in a circumferential direction, and a spring 138 for applying a circumferential preload to the load cell 136.

A bearing 140 is disposed between a downwardly projecting cylindrical member 130*a* of the drive unit 130 and an inner circumferential surface of the driven unit 132, thereby placing the driven unit 132 in a floating state. The driven unit 132 is connected to the screwdriver 72 by the coupling 98 and the coupling rod 94. The drive unit 130 and the driven unit 132 have essentially the same outside diameter.

Figure 5:
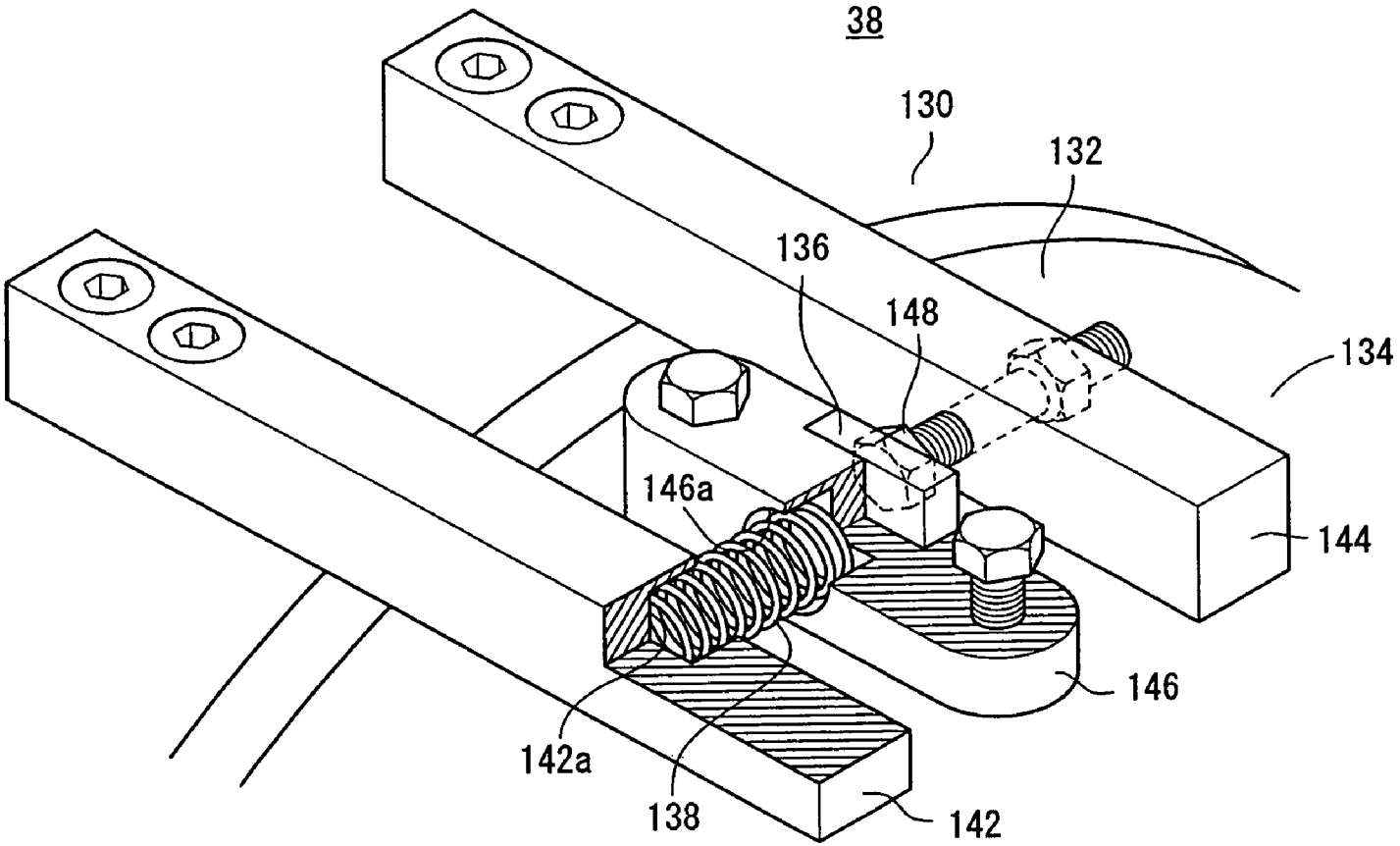
FIG. 5 is a perspective view, partly in cross section, of a torque detector.

As shown in FIG. 5, the drive force transmitting engagement unit 134 includes two fixing dogs 142, 144 mounted on a side surface of the drive unit 130 projecting downwardly (downwardly to the right in FIG. 5), and an engaging member 146 mounted on a side surface of the driven unit 132 and disposed between the fixing dogs 142, 144. As viewed from the engaging member 146, the fixing dog 142 is disposed on the left side and the fixing dog 144 is disposed on the right side.

The spring 138 has an end inserted in a bottomed circular hole 142*a* defined in a right side surface of the fixing dog 142 and the other end inserted in a bottomed circular hole 146*a* defined in a left side surface of the engaging member 146. The spring 138 is slightly compressed. The load cell 136 is mounted on a right side surface of the engaging member 146 and is held against an end of a pressing adjustment bolt 148 on the fixing dog 144. The pressing adjustment bolt 148 has a leftward projection, which is adjustable to adjust the compression of the spring 138. For example, if the load cell 136 has a measurement range of 100N, then the pressing adjustment bolt 148 is turned to adjust the compression of the spring 138 to apply a preload of 50N (=100N/2) to the load cell 136. Therefore, the torque applied in one direction to the driven unit 132 is proportionally detected as a force that is equal to or greater than 50N, and the torque applied in the reverse direction is proportionally detected as a force that is equal to or smaller than 50N. The force detected by the load cell 136 is supplied to the PLC 62, which subtracts the preload of 50N in order to cancel the offset, and then converts the force into a torque value T in view of the diameter of the driven unit 132.

According to a general torque detecting process for measuring circumferential strain using a strain gage, strain is small when the torque value is very small. Therefore, the general torque detecting process is not suitable for detecting very small torques applied to rotate the screwdriver 72, and further exhibits poor linearity.

The torque detector 38 can detect bidirectional torque values T, with a simple and inexpensive structure, using the single load cell 136. When the load cell 136 is preloaded by the spring 138, there is no clearance between the load cell 136 and the pressing adjustment bolt 148, making it possible to measure torques in a manner free of dead zones. Since the driven unit 132 is placed in a floating state with respect to the drive unit 130 due to the bearing 140, even very small torques can be measured highly accurately, without being affected by friction, and linearity is excellent.

Figure 6:
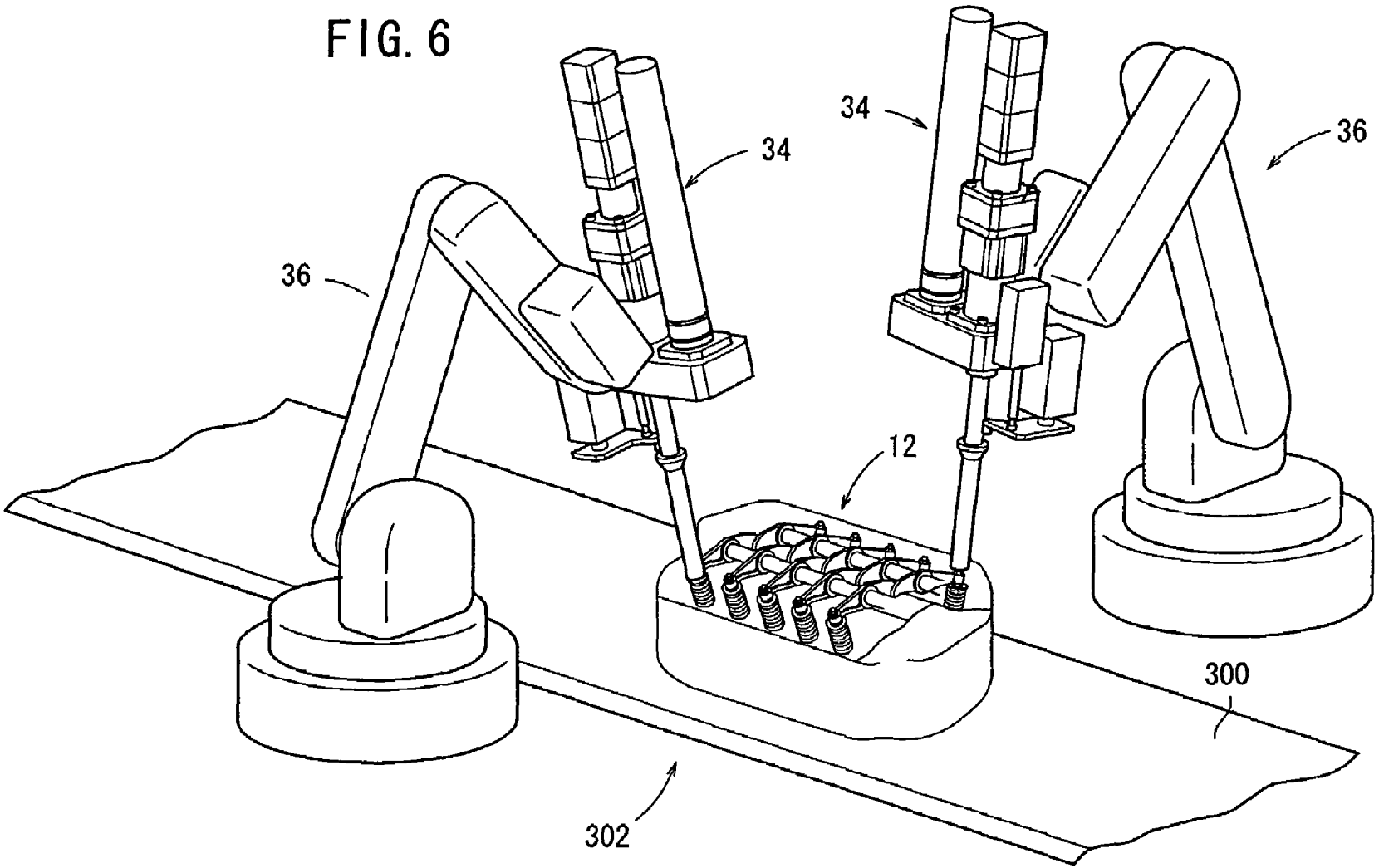
FIG. 6 is a perspective view of a station for making a tappet adjustment.

As shown in FIG. 6, the automatic tappet clearance adjusting apparatus 10 is installed in a station 302 on a production line 300. Engines 12 are successively fed along the production line 300. When an engine 12 is stopped at the station 302, the automatic tappet clearance adjusting apparatus 10 adjusts the tappet clearances C. After the tappet clearances C have been adjusted, the engine 12 is fed to a subsequent station. With this arrangement, the automatic tappet clearance adjusting apparatus 10 is capable of appropriately adjusting tappet clearances on mass-produced engines.

The station 302 has two automatic tappet clearance adjusting apparatuses 10 for sharing and adjusting adjustment screws 18, corresponding to a plurality of valves 14. Three or more automatic tappet clearance adjusting apparatuses 10 may be provided in a single station. The control mechanism 54 can be shared among all of the plural automatic tappet clearance adjusting apparatuses 10.

Figure 7:
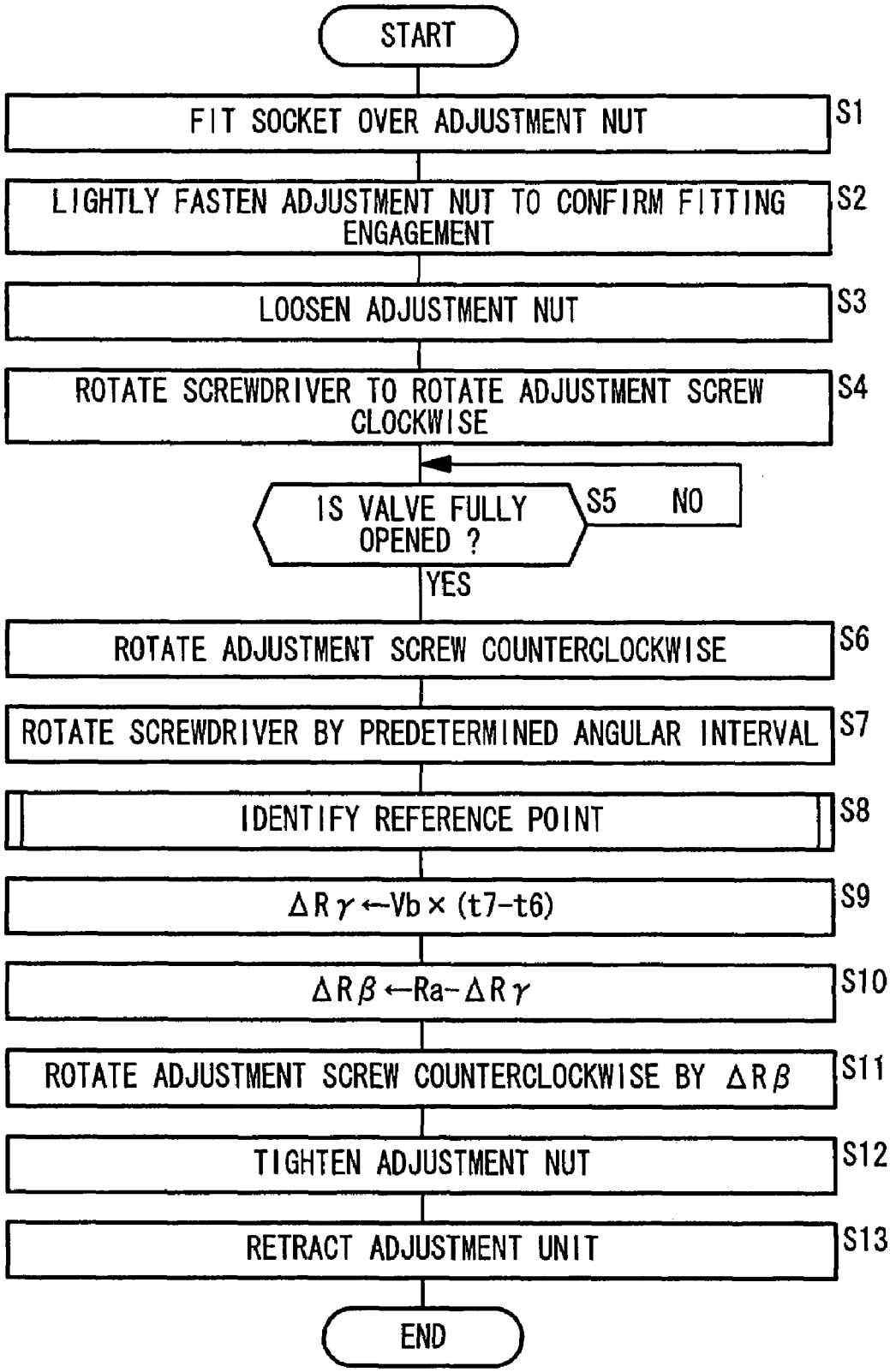
FIG. 7 is a flowchart showing a procedure of an automatic tappet clearance adjusting method according to the embodiment of the present invention.

A method of adjusting the tappet clearance C in the engine 12 using the automatic tappet clearance adjusting apparatus 10 thus constructed shall be described below with reference to FIG. 7.

In step S1, the robot controller 64 operates the robot 36 to move the adjustment unit 34 closely to the engine 12, and to cause the socket 76 of the working unit 70 (see FIG. 4) to be fitted over the adjustment nut 23. At this time, since the adjustment unit 34 is moved by the robot 36, which has a high degree of freedom, under programmed operations controlled by the robot controller 64, the adjustment unit 34 is flexible enough, even if the rocker arm 22 and the adjustment screw 18 have different positions and directions depending on the type of engine 12. A single automatic tappet clearance adjusting apparatus 10 can adjust the tappet clearances C of the cylinders of a multi-cylinder engine 12.

The distal end of the socket 76 floatingly abuts against the adjustment nut 23 and thereafter is fitted over the adjustment nut 23, whereupon the distal end of the socket 76 is seated on the rocker arm 22. Thereafter, the socket 76 moves slightly closer to the rotary tube 90 while resiliently compressing the spring 100, so that the distal end of the socket 76 is reliably fitted over the adjustment nut 23. Therefore, the robot 36 can bring the socket 76 into fitting engagement with the adjustment nut 23, in any desired position within a displacement range in which the spring 100 is resiliently deformable. At this time, the robot 36 can set the position and direction of the adjustment unit 34 based on the displacement of the rocker arm 22, which is measured by the magnescale 82, for thereby bringing the socket 76 into more reliable engagement with the adjustment screw 18.

At this time, the screwdriver 72 engages in the straight slot 18*a* of the adjustment screw 18 while resiliently compressing the spring 102.

In subsequent processes up to step S12, the robot 36 is synchronized in real time based on the displacement of the rocker arm 22, so as to bring the screwdriver 72 into accurate engagement within the straight slot 18*a*.

In step S2, the motor 114 of the nut runner 78 is energized to rotate the rotary tube 90 and the socket 76 in order to lightly rotate the adjustment nut 23 in a tightening direction. At this time, an increase in the torque applied to the socket 76 is detected by the torque detector 38 in order to confirm the fitting engagement between the socket 76 and the adjustment nut 23.

In step S3, the socket 76 is rotated in a reverse direction to loosen the adjustment nut 23, thereby releasing the double-nut engagement applied by the adjustment nut 23 and the adjustment screw 18. The adjustment screw 18 is now made rotatable and can start to be adjusted by the screwdriver 72.

In step S4, the servomotor 110 of the screwdriver rotator 74 is energized to rotate the coupling rod 94 and the screwdriver 72, in order to rotate the adjustment screw 18 clockwise. The PLC 62 begins to measure the torque value T based on the measurement by the load cell 136 and the angular displacement R of the servomotor 110. The PLC 62 also measures the torque value and the angular displacement R successively at predetermined small time intervals (sampling intervals ΔT in FIG. 13). Since the screwdriver 72 is biased so as to engage the adjustment screw 18 by the spring 102 (see FIG. 3), angular displacement R of the screwdriver 72 is proportional to the distance that the adjustment screw 18 is advanced or retracted. Therefore, measuring and controlling the angular displacement R is equivalent to measuring and controlling the distance that the adjustment screw 18 is advanced or retracted.

Figure 8:
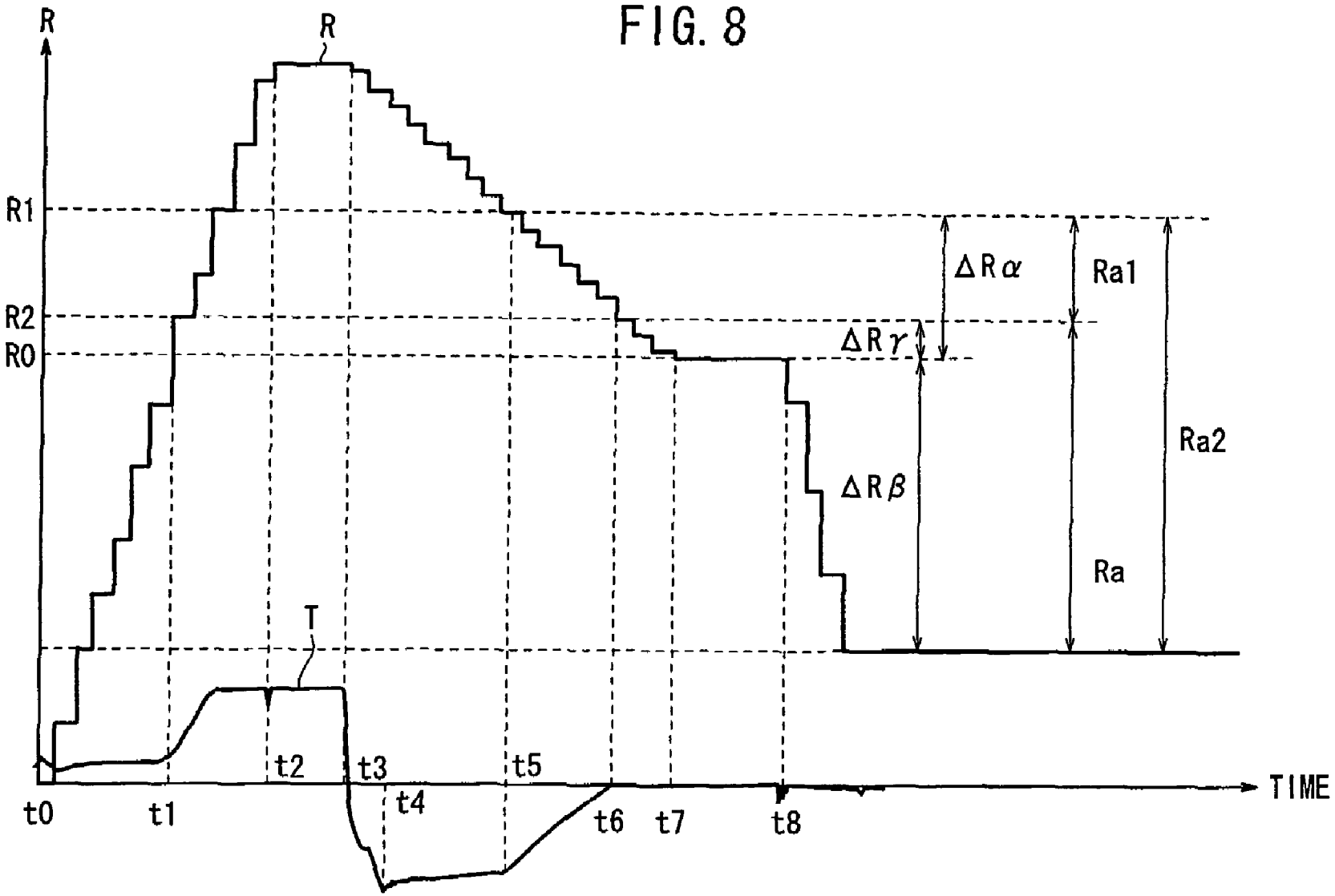
FIG. 8 is a graph of torque values and angular displacements for adjusting a tappet clearance.
Figure 9:
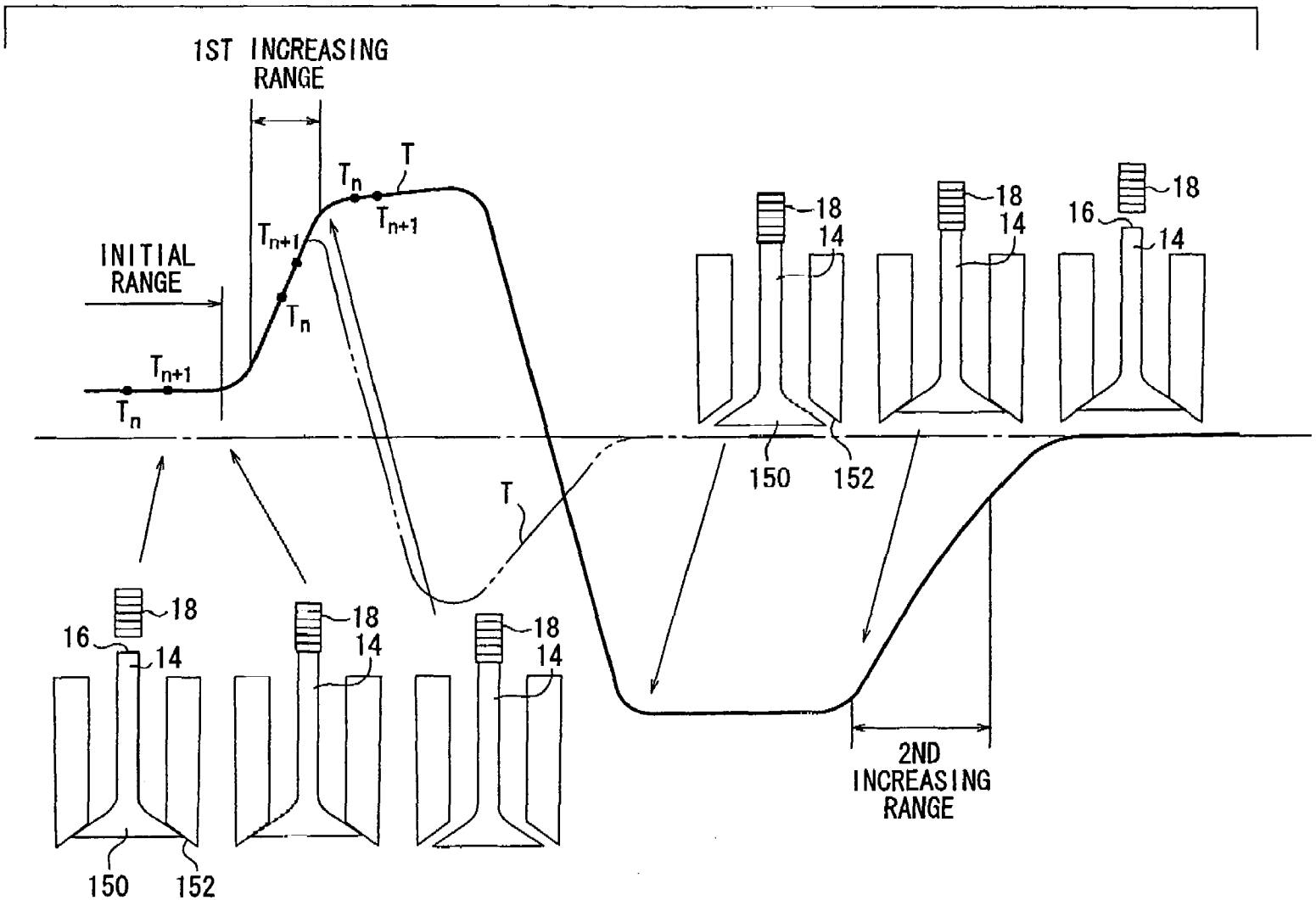
FIG. 9 is a diagram showing a comparison between torque value variations and valve states.

FIG. 8 is a graph of torque values T and angular displacements R measured by the PLC 62, with time at this point being represented by t0. FIG. 9 shows a comparison between variations of the torque values T and states of the valve 14.

Figure 10:
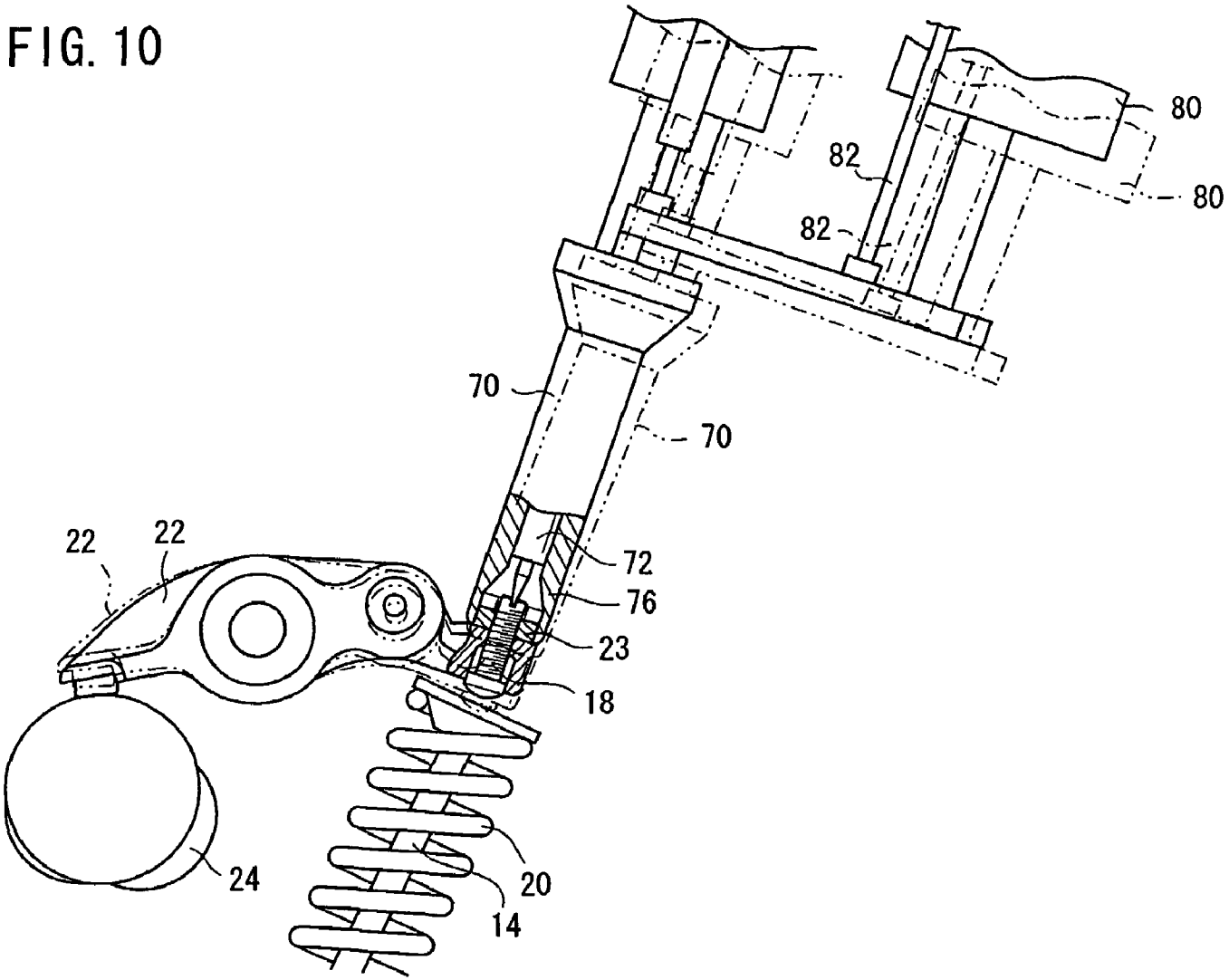
FIG. 10 is a view showing the manner in which the orientation of the adjustment unit is changed in synchronism with the displacement of a rocker arm.

As shown in FIG. 10, in step S4, based on displacement of the rocker arm 22 as detected by the magnescale 82, the adjustment unit 34 is operated in synchronism to achieve an appropriate position and direction for smoothly rotating the adjustment screw 18. Specifically, the adjustment unit 34 may be synchronized so as to make the adjustment screw 18 and the screwdriver 72 coaxial with each other.

Specifically, in a conventional tappet clearance adjusting apparatus, since a unit corresponding to the adjustment unit 34 is fixed, the screwdriver 72 may not be fitted accurately within the straight slot 18*a* of the adjustment screw 18, and the socket 76 may not be fitted accurately over the adjustment nut 23. By contrast, in the automatic tappet clearance adjusting apparatus 10, however, since the magnescale 82 can detect displacement of the rocker arm 22 in real time, and the adjustment unit 34 is mounted on a robot 36 having a high degree of freedom, the angle of approach can be changed in order to enable reliable and smooth adjustments while the robot 36 is maintained in synchronism with displacement of the rocker arm 22.

In step S5, measurements of the rotation of the adjustment screw 18 and the torque value T of the load cell 136 are continued in order to detect when the valve 14 is fully opened. Specifically, in FIG. 8, the torque value T starts increasing from a time t1 when the adjustment screw 18 first contacts the valve end 16. The valve 14 is fully opened at a time t2 when flexure, elongation, and backlash of the parts are eliminated. Subsequently, the torque value T gradually increases depending on the flexure of the spring 20. Step S5 is carried out as a subroutine (see FIG. 11). After the valve 14 is detected as being opened, control goes to step S6.

In step S6, the screwdriver rotator 74 operates to rotate the screwdriver 72 in a reverse direction, so that the adjustment screw 18 starts rotating counterclockwise at time t3 in FIG. 8.

The torque value T is quickly reduced and its polarity is inverted. The torque value T is reduced until time t4, when the absolute value thereof becomes substantially equal to the value before its polarity was inverted. After time t4, the torque value T gradually increases (the absolute value decreases) depending on the flexure of the spring 20.

After a valve head 150 contacts a valve seat 152 at time t5, the torque value T quickly increases (the absolute value decreases). The parts are subjected to flexure, elongation and backlash, and the valve 14 is fully closed at time t6, with the adjustment screw 18 being spaced from the valve end 16. After time t6, the torque value T becomes substantially nil.

In step S7, the screwdriver 72 is rotated a predetermined angular interval, which is preset with respect to the position at time t3. The screwdriver 72 is stopped at time t7 when the torque value T becomes substantially nil. The predetermined angular interval is set as a location before the torque value T becomes substantially nil and the tappet clearance C reaches an appropriate value. In FIG. 8, the angular position at the location is represented as a temporary stop position R0. The torque value T and the angular displacement R are recorded at small intervals (sampling intervals ΔT in FIG. 13), from time t3 to time t7, and are recorded substantially continuously.

In step S8, time t6 at which the adjustment screw 18 is spaced from the valve end 16 is determined by a subroutine, and an angular reference position R2 corresponding to the time t6 is identified as a reference point. This subroutine shall be described subsequently (see FIG. 12).

In step S9, a differential angular displacement ΔRγ between the temporary stop position R0 and the angular reference position R2 is determined as $\Delta R\gamma \leftarrow Vb \times (t7-t6)$, where Vb represents the rotational speed of the screwdriver 72. Alternatively, the differential angular displacement ΔRγ may be determined as $\Delta R\gamma \leftarrow R2-R0$ based on the temporary stop position R0 and the angular reference position R2, which have been recorded corresponding to times t5 and t6.

In step S10, a differential angular displacement ΔRβ between a predetermined angular displacement Ra and the differential angular displacement ΔRγ is determined as $\Delta R\beta \leftarrow Ra-\Delta R\gamma$. The predetermined angular displacement Ra is determined either experimentally or as a value produced by dividing the appropriate value of the clearance C, which is preset in design, by the pitch length of the adjustment screw 18.

In step S11, after time t8 (see FIG. 8) at which the processing of step S10 is finished, the screwdriver 72 rotates the adjustment screw 18 counterclockwise from the reference position by the differential angular displacement ΔRβ. The adjustment screw 18 is now retracted from the reference position, and the tappet clearance C reaches a value very close to the appropriate value that is preset in design. At this time, the screwdriver 72 stops being rotated.

In step S12, the nut runner 78 operates to tighten the adjustment nut 23, fixing the adjustment screw 18.

In step S13, the robot 36 operates to retract the adjustment unit 34. If another adjustment screw 18 remains unadjusted, then steps S1 through S13 are executed repeatedly on the unadjusted adjustment screw 18.

The subroutine in step S5 (see FIG. 7), for detecting when the valve 14 is fully opened, shall be described below with reference to FIG. 11.

In step S101, assuming that successively detected torque values T are represented by $T_n$ and $T_{n+1}$ (see FIG. 9), if a state wherein $T_{n+1}-T_n<K_1$ ($K_1$ and $K_2$ through $K_5$ indicate predetermined thresholds to be described later) occurs successively three times or more, then the torque value T is judged as being in a stable initial range, and control proceeds to step S103. If this condition is not satisfied, then the corresponding time is shifted by one sample (step S102), and step S101 is executed again.

If a state wherein $T_{n+1}-T_n>K_2$ occurs successively twice or more in step S103 after the initial range is determined in step S101, then the torque value T is judged as being within a first increasing range, and control proceeds to step S105. If this condition is not satisfied, then the corresponding time is shifted by one sample (step S104), and step S103 is executed again.

Figure 11:
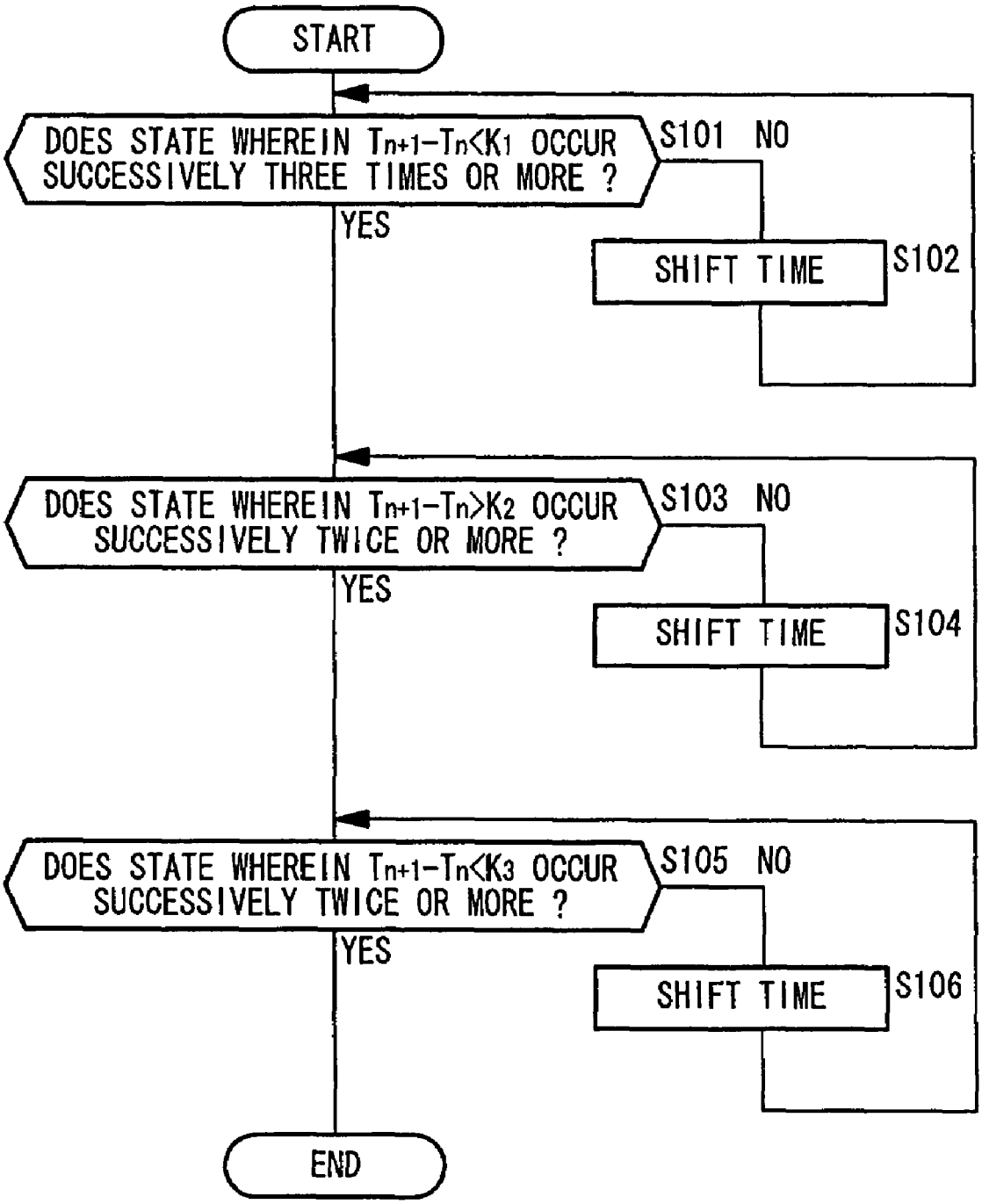
FIG. 11 is a flowchart of a subroutine for detecting when a valve is fully opened.

If a state wherein $T_{n+1}-T_n<K_3$ occurs successively twice or more in step S105 after the first increasing range is determined in step S103, then since increasing of the torque value T has ended, the valve 14 is detected as being fully opened, and the process shown in FIG. 11 is put to an end. If this condition is not satisfied, then the corresponding time is shifted by one sample (step S106), and step S105 is executed again.

The processing of step S105 is essentially a differential process. If a state wherein a differential value is smaller than a predetermined threshold occurs successively a predetermined number of times, then the valve 14 is judged as being opened.

According to the above process, it is possible to reliably detect a first increasing range, in which the torque value T increases based on flexure, etc., of the valve 14 after the adjustment screw 18 contacts the valve end 16, as well as to separately detect an initial range prior thereto and a subsequent zone in which the valve 14 is fully opened. Due to the processing of step S105, the valve 14 can reliably be advanced until it is fully opened.

Though not described in detail, after the first increasing range is detected, processing of steps S101 through S106 is performed again on a region subsequent to the first increasing range, in order to detect a second increasing range in which the torque T increases again after having been reduced.

If a change, e.g., an increase or a reduction, in the torque value T is detected without the need for the valve 14 to be fully opened, then the second increasing range appears thereafter, and it is possible to identify a reference point with respect to the valve seat 152 of the valve 14. Therefore, steps S105 and S106 of the process shown in FIG. 11 can be dispensed with. In this case, the process may be completed when the torque value T increases a prescribed value (e.g., 0.2 Nm) within the first increasing range. If steps S105 and S106 are thus dispensed with, then peak and valley levels of the torque value T are reduced and the process occurs in a shorter period of time, as indicated by the two-dot-and-dash-line curve in FIG. 9, resulting in a reduction in the adjustment time.

Figure 12:
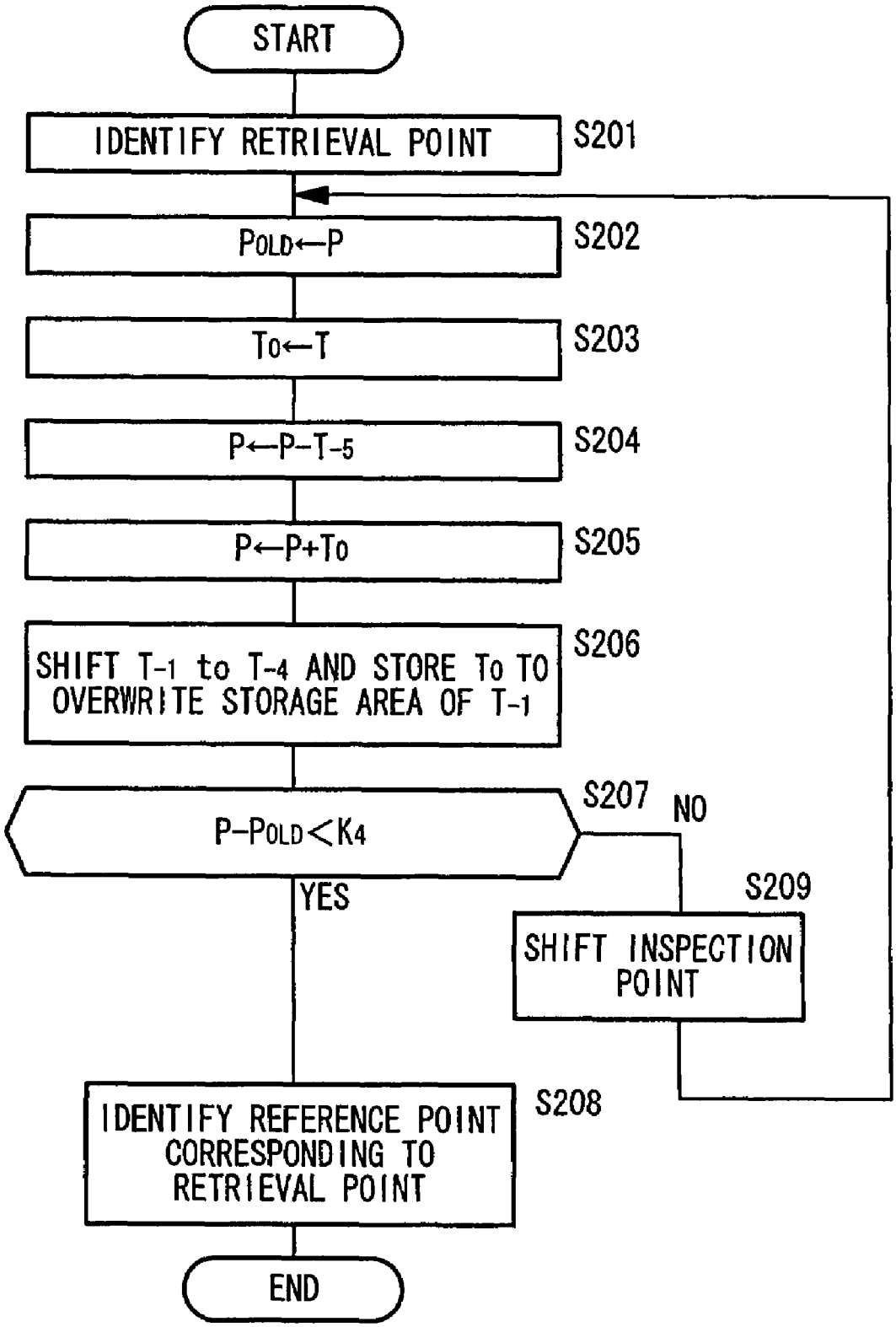
FIG. 12 is a flowchart of a subroutine for identifying a reference point.

The subroutine in step S8, for identifying the angular reference position R2 corresponding to time t6 as a reference point, shall be described below with reference to FIGS. 12 through 14.

In step S201, a suitable time within the second increasing range is identified as a retrieval point.

In step S202, a parameter P, serving as a filtering value for the torque value T, is substituted in a parameter $P_{OLD}$ used for purposes of comparison. That is, $P_{OLD} \leftarrow P$. The parameter P has an initial value of 0.

In step S203, the torque value T at the retrieval point is read, and substituted into the parameter $T_0$ as a retrieval point torque. That is, $T_0 \leftarrow T$.

In step S204, $T_{-5}$, which represents the torque value T at the fifth retrieval point prior to the present retrieval point, is subtracted from the filtering value P. That is, $P \leftarrow P - T_{-5}$. However, if the number of times that the loop process shown in FIG. 12 has been executed is five or less, then since $T_{-5}$ is not defined, it is set to $T_{-5}=0$.

In step S205, the retrieval point torque $T_0$ determined in step S203 is added to the filtering value P. That is, $P \leftarrow P + T_0$.

In step S206, torque values $T_{-1}$ to $T_{-4}$, which are stored respectively at the first through fourth retrieval points prior to the present retrieval point, are changed to $T_{-5} \leftarrow T_{-4}$, $T_{-4} \leftarrow T_{-3}$, $T_{-3} \leftarrow T_{-2}$, $T_{-2} \leftarrow T_{-1}$, and the retrieval point torque $T_0$ is stored by overwriting the storage area for $T_{-1}$.

In step S207, it is confirmed whether the difference between the updated filtering value P and the parameter $P_{OLD}$, which is of a value before being updated, is smaller than a threshold $K_4$ or not. In other words, the condition of $P - P_{OLD} < K_4$ is confirmed. If this condition is satisfied, then control proceeds to step S208. If this condition is not satisfied, then the retrieval point is shifted by one sample (step S209), after which the control returns back to step S202 to continue the process.

In step S208, the retrieval point at that time is specified as time t6, and the angular reference position R2 that corresponds to time t6 is retrieved from memory or is determined by means of a predetermined interpolating process, and identified as a reference point. Thereafter, based on the determined angular reference position R2, the processing from step S9 (see FIG. 7) is carried out in order to adjust the tappet clearance C.

Figure 13:
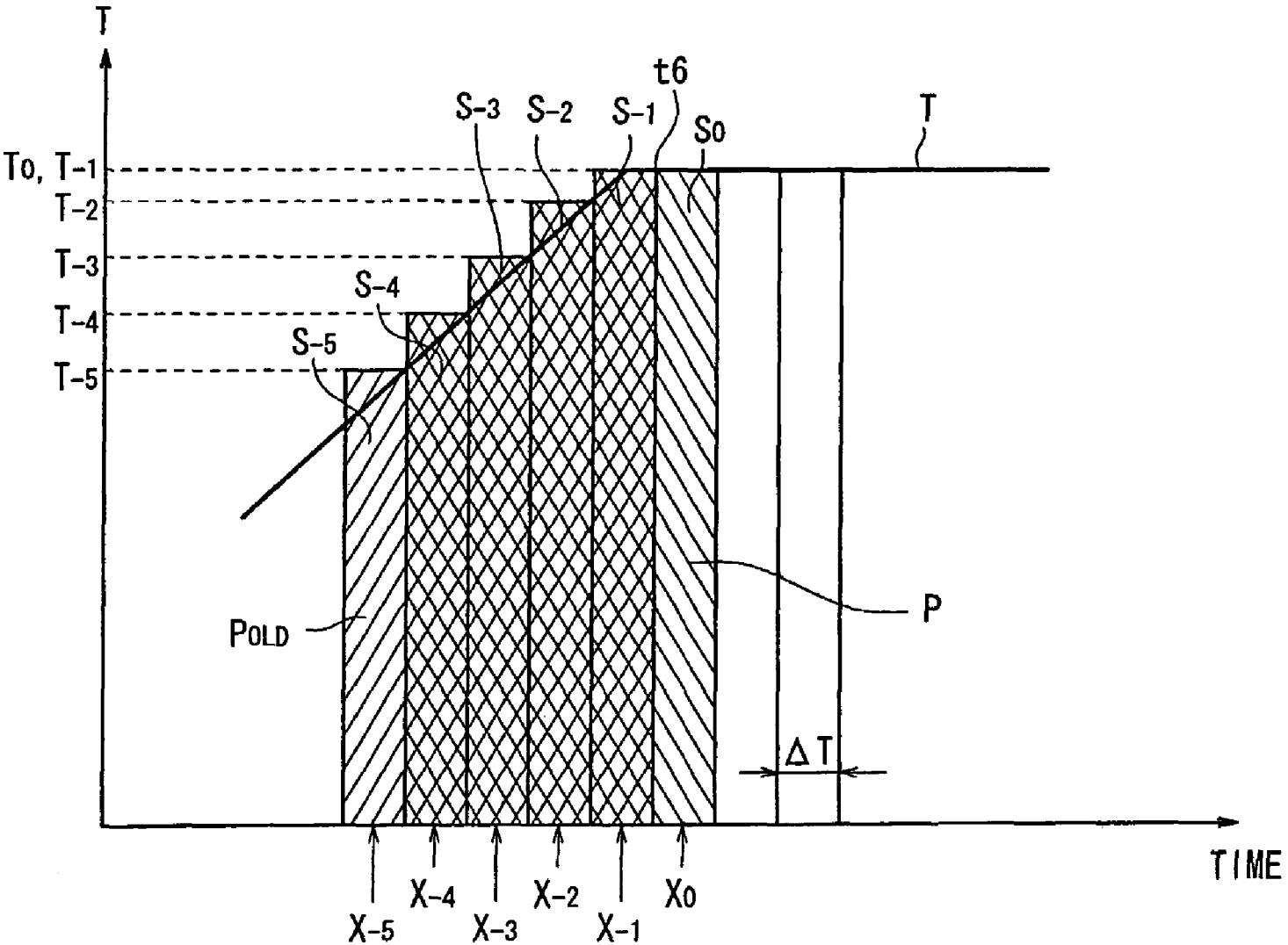
FIG. 13 is a diagram showing the relationship between torque values and moving average filtering values.
Figure 14:
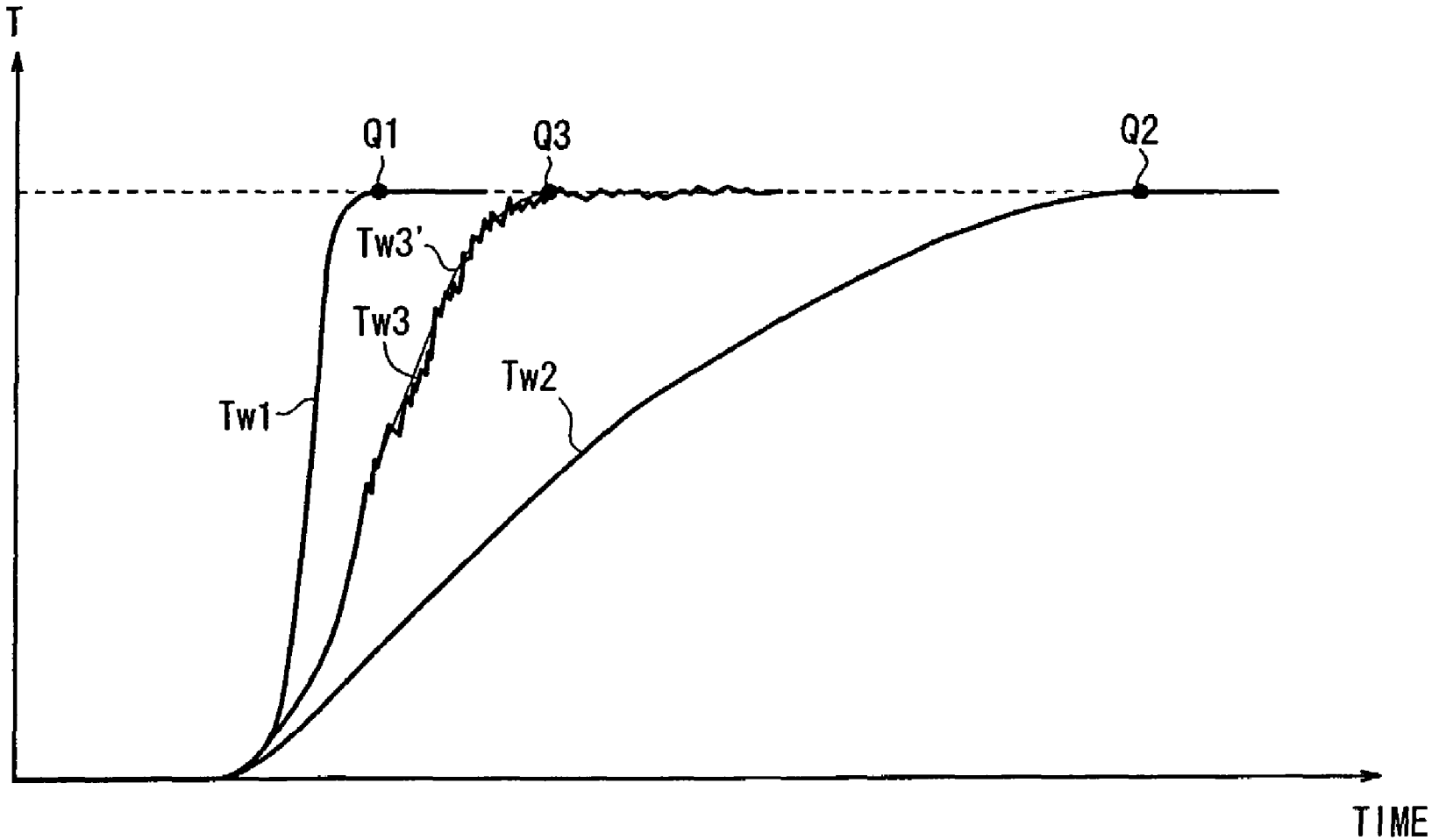
FIG. 14 is a graph showing, in an enlarged scale, torque values at a time when the valve is closed.

The above process is schematically illustrated in FIG. 13. As shown in FIG. 13, if the present time that serves as the retrieval point is represented by $X_0$, then times made up of the preceding retrieval point through the fifth retrieval point prior to the present retrieval point are represented by $X_{-1}$, $X_{-2}$, $X_{-3}$, $X_{-4}$, $X_{-5}$. Products of the torque values $T_0$ through $T_{-5}$ and the sampling interval $\Delta T$ are indicated as areas $S_0$ through $S_{-5}$. $\Delta T$ is simplified as $\Delta T=1$ for such calculations.

The filtering value P is given as $P=S_0+S_{-1}+S_{-2}+S_{-3}+S_{-4}$, and is shown in FIG. 13 as a hatched area, with oblique lines extending downwardly to the right. The parameter $P_{OLD}$ is given as $P_{OLD}=S_{-1}+S_{-2}+S_{-3}+S_{-4}+S_{-5}$, and is shown in FIG. 13 as a hatched area, with oblique lines extending upwardly to the right. Since the filtering value P is expressed as an area $(S_0+S_{-1}+S_{-2}+S_{-3}+S_{-4})$ that moves with time, it is smoothed by a moving average value. Time t6 is identified as a location where the gradient of the filtering value P is equal to or smaller than the threshold $K_4$.

The difference $P-P_{OLD}$ between the filter value P and the parameter $P_{OLD}$, determined by the comparing process in step S207, can be expressed as $P-P_{OLD}=(S_0+S_{-1}+S_{-2}+S_{-3}+S_{-4})-(S_{-1}+S_{-2}+S_{-3}+S_{-4}+S_{-5})=S_0-S_{-5}$. Consequently, in step S207, if $\Delta T$ is simplified and set at $\Delta T=1$, such a comparison can be made based on the difference between the torque $T_0$ and the torque $T_{-5}$.

As described above, the automatic tappet clearance adjusting apparatus 10 according to the present embodiment identifies the time t6 according to a process based on the smoothed filtering value P. Therefore, as shown in FIG. 14, even if the waveform of the torque value T is different from a standard waveform, e.g., if the torque value T is represented by a sharply rising waveform $T_{W1}$, a gradually rising waveform $T_{W2}$, or a noise-added waveform $T_{W3}$, or even if the waveform of the torque value T is different depending on the types of each of the various engines 12, the automatic tappet clearance adjusting apparatus 10 can still be used. Specifically, since the points Q1, Q2, Q3, where the waveforms $T_{W1}$, $T_{W2}$, $T_{W3}$ converge to a normal value, can accurately be identified and made to correspond to time t6, the angular reference position R1 can accurately be identified. Particularly, even though it is difficult to analyze the unstable waveform $T_{W3}$ itself as shown in FIG. 14, the convergent point Q3 can accurately be identified, because the waveform $T_{W3}$ can be converted into a smoother waveform through filtering, as indicated by the thin-lined waveform curve $T_{W3}'$.

According to the process of identifying the point at which the adjustment screw 18 is brought into contact with the valve 14 as a reference point, it may be difficult to identify the reference point highly accurately due to individual differences of the screw section of the adjustment screw 18. However, since the automatic tappet clearance adjusting apparatus 10 according to the present embodiment identifies, as the reference point, the angular reference position R2 based on a change in the torque value T at the time the valve 14 is retracted, the reference point can be identified highly accurately regardless of play in the adjustment screw 18 that engages in the straight slot 18*a*, backlash of the drive system, etc.

All of the processes performed by the automatic tappet clearance adjusting apparatus 10 for adjusting tappet clearance are automatically carried out under the control of the control mechanism 54. Therefore, the automatic tappet clearance adjusting apparatus 10 is effective as a labor saver for several workers, and the apparatus is capable of adjusting tappet clearances more quickly and accurately than workers. Furthermore, inasmuch as the automatic tappet clearance adjusting apparatus 10 can selectively and flexibly carry out a plurality of operations under a programmed control, the apparatus is suitable for adjusting a large quantity of engines 12 having a wide variety of engine types.

The engine 12 that is adjusted by the automatic tappet clearance adjusting apparatus 10 is a complete product made up of an assembly of major components including a cylinder head, pistons 26, and a crankcase. The adjustment process is done as an independent process after the assembly process for the engine 12 has been completed. Since no subsequent assembling process is required, the adjustment once it has been made is not changed. The adjustment process is also simple, since no advance disassembling process is needed.

Since the automatic tappet clearance adjusting apparatus 10 does not have any means for fixing the rocker arm 22, the rocker arm 22 may become slightly displaced upon adjustment. However, since the automatic tappet clearance adjusting apparatus 10 successively measures the torque value T, and identifies a reference point based on the differential value of the torque value T, the apparatus can adjust tappet clearances independently of the displacement of the rocker arm 22, and thus can adjust the tappet clearance with a simple structure, since no means for fixing the rocker arm 22 is required.

In the above example, the angular reference position R2, based on time t6 at which the adjustment screw 18 is spaced from the valve end 16, is identified as a reference point. However, the angular reference position R1, based on time t5 at which the valve head 150 contacts the valve seat 152, may also be identified as a reference point.

In such a case, the retrieval point is set to a time prior to the second increasing range (see FIG. 9) in step S201, and if a branching condition ($P-P_{OLD}>K_4$) corresponding to step S207 is satisfied, the torque value T is judged as beginning to increase, thereby specifying the time t5. Then, the differential angular displacement $\Delta R\alpha$ (=R1−R0) between the angular reference position R1 (see FIG. 8) corresponding to time t5 and the temporary stop position R0 is determined, and further, the differential angular displacement $\Delta R\beta$ between a second predetermined angular displacement Ra2 and the differential angular displacement $\Delta R\alpha$ is determined as $\Delta R\beta \leftarrow Ra2-\Delta R\alpha$.

The second predetermined angular displacement Ra2 is given as an angular displacement from the position at a time (i.e., time t5) when the valve head 150 contacts the valve seat 152, and until the valve 14 moves to a position where the tappet clearance C becomes an appropriate value (e.g., 0.3 mm) preset in design. The second predetermined angular displacement Ra2 is determined either experimentally or by calculation, and is recorded in advance.

A first predetermined angular displacement Ra1 represents the difference between the angular reference position R1 corresponding to time t5 and the angular reference position R2 corresponding to time t6, and is determined based on flexure and elongation of the parts. The predetermined angular displacement Ra is determined either experimentally or as a value that is produced by dividing an appropriate value of the clearance C, which is preset in design, by the pitch length of the adjustment screw 18.

The angular reference positions R1, R2, which serve as reference points for adjusting the tappet clearance C, can thus be determined as corresponding to times t5 and t6. Either one of the locations may be used as a reference point, based on experiments and studies conducted for each type of engine 12, wherein a process based on an optimum location may be selected.

The torque detector 38 has been described above as being of a type having a single load cell 136 (see FIG. 5). However, two load cells 136 may be employed for individually detecting torque values T for clockwise rotation and counterclockwise rotation, respectively. In this case, the preloading spring 138 may be dispensed with.

The process of filtering the torque value T is not limited to using a moving average process, but may be performed by using an appropriate digital filter or the like.

The automatic tappet clearance adjusting apparatus and adjusting method according to the present invention is not limited to the above embodiments, but may have various arrangements without departing from the gist of the present invention.

The invention claimed is:

1. An automatic tappet clearance adjusting apparatus for adjusting a clearance between a valve and an adjustment screw in an engine, in which said valve that is closed by a spring is opened by being pressed by said adjustment screw on a distal end of a rocker arm, comprising:

an adjustment unit for advancing and retracting said adjustment screw from the distal end of said rocker arm to adjust a projection of said adjustment screw;

a torque detector for detecting a torque to rotate said adjustment screw; and a control mechanism for controlling said adjustment unit based on a bidirectional torque value successively measured by said torque detector, wherein said control mechanism determines a filtering value produced by smoothing said torque value applied to retract said adjustment screw to close said valve from a state in which said valve is open, identifies, as the reference point, either a location at which a valve head of said valve first contacts a valve seat of said engine, in order to start reducing said filtering value, or a location at which after said valve head of said valve contacts said valve seat of said engine, said adjustment screw is spaced from an end of said valve to thereby hold said filtering value at a constant value, and retracts said adjustment screw from the current position to a position retracted by a set quantity based on said clearance from said reference point.

2. An automatic tappet clearance adjusting apparatus according to claim 1, wherein said filtering value is determined by a moving average process.

3. An automatic tappet clearance adjusting apparatus according to claim 1, wherein said adjustment unit is moved by a programmable multiaxis robot to change an angle of approach while said robot is maintained in synchronism with displacement of said rocker arm.

4. An automatic tappet clearance adjusting apparatus according to claim 1, wherein the tappet clearance adjusting apparatus is installed in a station on a production line.

5. An automatic tappet clearance adjusting method, for adjusting a clearance between a valve and an adjustment screw in an engine in which said valve that is closed by a spring is opened by being pressed by said adjustment screw on a distal end of a rocker arm, comprising the step of employing:

an adjustment unit for advancing and retracting said adjustment screw from the distal end of said rocker arm in order to adjust the projection of said adjustment screw;

a torque detector for detecting a torque to rotate said adjustment screw; and a control mechanism for controlling said adjustment unit based on a bidirectional torque value as successively measured by said torque detector, wherein said control mechanism determines a filtering value produced by smoothing said torque value applied to retract said adjustment screw to close said valve from a state in which said valve is open, identifies, as the reference point, either a location at which a valve head of said valve first contacts a valve seat of said engine, in order to start reducing said filtering value, or a location at which after which said valve head of said valve contacts said valve seat of said engine, said adjustment screw is spaced from an end of said valve to thereby hold said filtering value at a constant value, and then retracts said adjustment screw from the current position to a position retracted by a set quantity based on said clearance from said reference point.

6. An automatic tappet clearance adjusting method according to claim 5, wherein said filtering value is determined by a moving average process.

7. An automatic tappet clearance adjusting method according to claim 5, wherein said adjustment unit is moved by a programmable multiaxis robot to change an angle of approach while said robot is maintained in synchronism with displacement of said rocker arm.

8. An automatic tappet clearance adjusting method according to claim 5, wherein the tappet clearance adjusting method is carried out in a station on a production line.

* * * * *